US007744981B2

(12) United States Patent
Vazquez Santiago

(10) Patent No.: US 7,744,981 B2
(45) Date of Patent: Jun. 29, 2010

(54) EMBOSSED MULTI-PLY FIBROUS STRUCTURE PRODUCT

(75) Inventor: Arnaldo Vazquez Santiago, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/707,686

(22) Filed: Feb. 16, 2007

(65) Prior Publication Data

US 2007/0207293 A1 Sep. 6, 2007

Related U.S. Application Data

(60) Provisional application No. 60/779,477, filed on Mar. 6, 2006, provisional application No. 60/800,251, filed on May 12, 2006.

(51) Int. Cl.

| | |
|---|---|
| ***B31F 1/12*** | (2006.01) |
| ***D21H 27/40*** | (2006.01) |
| ***B32B 3/12*** | (2006.01) |
| ***B32B 27/14*** | (2006.01) |
| ***B32B 3/00*** | (2006.01) |

(52) U.S. Cl. ..... 428/172; 428/153; 428/154; 428/178; 428/198

(58) Field of Classification Search ..... 428/153, 428/154, 156, 166, 178, 172, 198; 162/109, 162/111

See application file for complete search history.

(56) References Cited

U.S. PATENT DOCUMENTS

| | | | | |
|---|---|---|---|---|
| 4,469,735 | A | 9/1984 | Trokhan | |
| 5,294,475 | A | 3/1994 | McNeil | |
| 5,356,506 | A | 10/1994 | McNeil et al. | |
| 5,436,057 | A | 7/1995 | Schulz et al. | |
| 5,468,323 | A | 11/1995 | McNeil | |
| 5,597,639 | A * | 1/1997 | Schulz | 428/156 |
| 6,086,715 | A | 7/2000 | McNeil | |
| 6,113,723 | A | 9/2000 | McNeil et al. | |
| 6,129,972 | A | 10/2000 | McNeil et al. | |
| 6,277,466 | B1 | 8/2001 | McNeil et al. | |
| 6,423,397 | B1 | 7/2002 | Roussel | |

(Continued)

FOREIGN PATENT DOCUMENTS

| | | |
|---|---|---|
| WO | WO 02/28630 A2 | 4/2002 |

(Continued)

OTHER PUBLICATIONS

PCT Search Report mailed Oct. 19, 2007.

*Primary Examiner*—David R Sample
*Assistant Examiner*—Catherine Simone
(74) *Attorney, Agent, or Firm*—Betty J. Zea

(57) ABSTRACT

An embossed multi-ply fibrous structure product having enhanced quilted appearance comprising: two or more plies of fibrous structure wherein at least one of the piles has a plurality of embossments thereon having a total embossment area of from about 6% to about 16%; the embossments forming a latticework defining a plurality of unembossed cells; wherein each cell has a surface area of from about 0.5 square inches to about 6 square inches, the cells being unadhered to the adjacent ply and the embossments having a height from about 350 μm to about 1,500 μm. Further embodiment comprise a product having a Percent Compressibility from about 1.5% to about 4.5%.

23 Claims, 3 Drawing Sheets

U.S. PATENT DOCUMENTS

| | | | | |
|---|---|---|---|---|
| 6,455,129 | B1 | 9/2002 | Kershaw et al. | |
| 6,602,577 | B1 | 8/2003 | Ostendorf et al. | |
| 2003/0021954 | A1 | 1/2003 | Graff | |
| 2004/0168780 | A1 * | 9/2004 | Dwiggins et al. | 162/125 |
| 2005/0069679 | A1 | 3/2005 | Stelljes et al. | |
| 2005/0069680 | A1 | 3/2005 | Stelljes et al. | |
| 2006/0278354 | A1 | 12/2006 | Russell et al. | |
| 2006/0278356 | A1 | 12/2006 | Boatman et al. | |
| 2006/0280909 | A1 | 12/2006 | Kien et al. | |
| 2006/0280910 | A1 | 12/2006 | Boatman et al. | |
| 2007/0062658 | A1 | 3/2007 | Wiwi et al. | |

FOREIGN PATENT DOCUMENTS

| | | | |
|---|---|---|---|
| WO | WO 2005/032320 | A2 | 4/2005 |
| WO | WO2005080677 | A3 | 11/2006 |
| WO | WO 2006/133389 | A2 | 12/2006 |

* cited by examiner

EMBOSSED MULTI-PLY FIBROUS STRUCTURE PRODUCT

CROSS-REFERENCE TO RELATED APPLICATIONS

This application claims the benefit of provisional application Ser. No. 60/779,477, filed Mar. 6, 2006, and provisional application Ser. No. 60/800,251, filed May 12, 2006.

FIELD OF THE INVENTION

The present invention relates to multi-ply fibrous structure products, more specifically embossed multi-ply fibrous structure products having enhanced quilted appearance.

BACKGROUND OF THE INVENTION

Cellulosic fibrous structures are a staple of everyday life. Cellulosic fibrous structures are used as consumer products for paper towels, toilet tissue, facial tissue, napkins, and the like. The large demand for such paper products has created a demand for improved versions of the products and the methods of their manufacture.

Some consumer prefer embossed cellulosic fibrous structure products that have a softer, more three-dimensional, quilted appearance. Consumers also desire products having the appearance of relatively high caliper with aesthetically pleasing decorative patterns exhibiting a high quality cloth-like appearance. Such attributes, however, must be provided without sacrificing the other desired functional qualities of the product such as softness, absorbency, drape (flexibility/limpness) and bond strength between the plies.

Multiple ply cellulosic fibrous structures are known in the art of consumer products. Such products are cellulosic fibrous structures having more than one, typically two, plies superimposed in face-to-face relationship to form a laminate. It is known in the art to emboss sheets comprising multiple plies of tissue for aesthetic purposes and to maintain the plies in face-to-face relation during use. In addition, embossing can increase the surface area of the plies thereby enhancing their bulk and water holding capacity.

The prior art teaches that embossing may improve appearance and generally improves (i.e.; increases) the functional attributes of absorbency, compressibility, and bulk of the paper product while it may negatively impact the drape (i.e.; increasing the bending stiffness) of the paper. The prior art also teaches that lamination may improve appearance and may generally improve bulk while negatively impacting drape.

Nonetheless, striking a balance between embossing/laminating used to create an aesthetically pleasing product without sacrificing the functional attributes of the product has always been difficult.

Hence, the present invention unexpectedly provides an aesthetically pleasing tissue/towel product with high quality cloth-like appearance as well as an enhanced quilted appearance while maintaining absorbency, softness, drape, and bond strength between the plies. The present invention provides a multiply fibrous structure product for optimizing this relationship.

SUMMARY OF THE INVENTION

An embossed multiply fibrous structure product, having enhanced quilted appearance, comprising:

two or more plies of fibrous structure wherein at least one of the piles has a plurality of embossments thereon having a total embossment area of from about 6% to about 16%; the embossments forming a latticework defining a plurality of unembossed cells; wherein each cell has a surface area of from about 0.5 square inches to about 6 square inches, the cells being unadhered to the adjacent ply and the embossments having a height from about 350 μm to about 1,500 μm.

In one embodiment the product is a two ply product having only one embossed ply and having a sheet caliper from about 20 to about 40 mils. In another embodiment the fibrous structure product has enhanced roll firmness and the appearance of a more uniformly rolled product whereby the product has a Percent Compressibility from about 1.5% to about 4.5%

BRIEF DESCRIPTION OF THE DRAWINGS

While the specification concludes with claims that particularly point out and distinctly claim the present invention, it is believed that the present invention will be understood better from the following description of embodiments, taken in conjunction with the accompanying drawings, in which like reference numerals identify identical elements.

Without intending to limit the invention, embodiments are described in more detail below.

DETAILED DESCRIPTION OF THE INVENTION

Definitions

Figure 1:
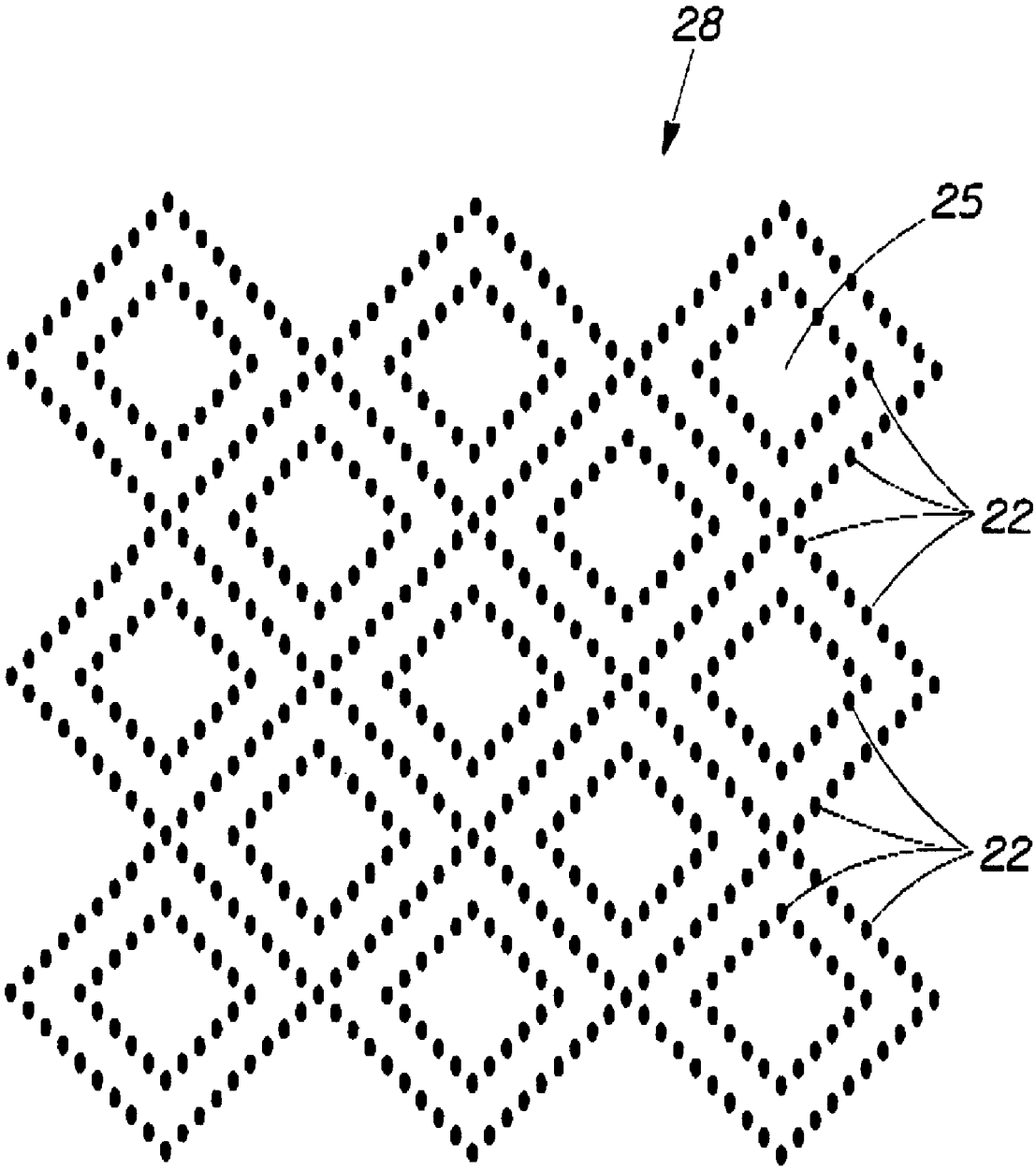
FIG. 1 is a fragmentary plan view of a multiple ply paper product displaying an embodiment of a non-random embossment pattern latticework on the first ply or the second ply made according to the present invention.

As used herein, "paper product" refers to any formed, fibrous structure products, traditionally, but not necessarily, comprising cellulose fibers. In one embodiment, the paper products of the present invention include tissue-towel paper products.

A "tissue-towel paper product" refers to creped and/or uncreped products comprising paper tissue or paper towel technology in general, including, but not limited to, conventional felt-pressed or conventional wet-pressed tissue paper, pattern densified tissue paper, starch substrates, and high bulk, uncompacted tissue paper. Non-limiting examples of tissue-towel paper products include toweling, facial tissue, bath tissue, table napkins, and the like.

"Ply" or "Plies", as used herein, means an individual fibrous structure or sheet of fibrous structure, optionally to be disposed in a substantially contiguous, face-to-face relationship with other plies, forming a multi-ply fibrous structure. It is also contemplated that a single fibrous structure can effectively form two "plies" or multiple "plies", for example, by being folded on itself. In one embodiment, the ply has an end use as a tissue-towel paper product. A ply may comprise one or more wet-laid layers, air-laid layers, and/or combinations thereof. If more than one layer is used, it is not necessary for each layer to be made from the same fibrous structure. Further, the layers may or may not be homogenous within a layer. The actual makeup of a tissue paper ply is generally determined by the desired benefits of the final tissue-towel paper product, as would be known to one of skill in the art. The fibrous structure may comprise one or more plies of non-woven materials in addition to the wet-laid and/or air-laid plies.

The term "fibrous structure", as used herein, means an arrangement of fibers produced in any papermaking machine known in the art to create a ply of paper. "Fiber" means an elongate particulate having an apparent length greatly exceeding its apparent width. More specifically, and as used herein, fiber refers to such fibers suitable for a papermaking process.

"Basis Weight", as used herein, is the weight per unit area of a sample reported in lbs/3000 $ft^2$ or $g/m^2$. Basis weight is measured by preparing one or more samples of a certain area ($m^2$) and weighing the sample(s) of a fibrous structure according to the present invention and/or a fibrous structure product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$). The basis weight ($g/m^2$) is calculated by dividing the average weight (g) by the average area of the samples ($m^2$). This method is herein referred to as the Basis Weight Method.

"Machine Direction" or "MD", as used herein, means the direction parallel to the flow of the fibrous structure through the papermaking machine and/or product manufacturing equipment.

"Cross Machine Direction" or "CD", as used herein, means the direction perpendicular to the machine direction in the same plane of the fibrous structure and/or fibrous structure product comprising the fibrous structure.

"Sheet Caliper" or "Caliper", as used herein, means the macroscopic thickness of a product sample as determined by the Sheet Caliper Test Method disclosed herein.

"Densified", as used herein, means a portion of a fibrous structure product that is characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. One embodiment of a method of making a pattern densified fibrous structure and devices used therein are described in U.S. Pat. Nos. 4,529,480 and 4,528,239. For example, a densified area of the embossed multi-ply fibrous structure product according to the present invention is typically 0.19 g/cc or greater. In one embodiment of the present invention, the embossed multi-ply fibrous structure product comprises a densified area that is at least 2 times the density of another portion of the embossed multi-ply fibrous structure product.

"Non-densified", as used herein, means a portion of a fibrous structure product that exhibits a lesser density than another portion of the fibrous structure product. For example, a non-densified area of the embossed multi-ply fibrous structure product according to the present invention is typically less than about 0.19 g/cc. In one embodiment of the present invention, the embossed multi-ply fibrous structure product comprises a non-densified area that is less than 2 times the density of another portion of the embossed multi-ply fibrous structure product.

"Embossing" or "embossments", as used herein, refers to the process of deflecting a relatively small portion of a cellulosic fibrous structure normal to its plane and impacting the projected portion of the fibrous structure against a relatively hard surface to permanently disrupt the fiber to fiber bonds.

"Repeating" means the pattern is formed more than once.

"Discrete" means the adjacent embossed sites are not contiguous.

"Essentially continuous" refers to a region extending substantially throughout the fibrous structure in one or both of its principal directions.

A "latticework" is a pattern of intersecting diagonal or zigzag segments or angles.

A "cell" is a unit of a two- or three dimensional array comprising a group of unembossed individual enclosures surrounded by a discrete, repeating, embossed pattern.

"Laminating" refers to the process of firmly uniting superimposed layers of paper with or without adhesive, to form a multi-ply sheet.

Embossed Multi-Ply Fibrous Structure Product

The present invention is equally applicable to all types of consumer paper products such as paper towels, toilet tissue, facial tissue, napkins, and the like.

The present invention contemplates the use of a variety of paper making fibers, such as, natural fibers, synthetic fibers, as well as any other suitable fibers, starches, and combinations thereof. Paper making fibers useful in the present invention include cellulosic fibers commonly known as wood pulp fibers. Applicable wood pulps include chemical pulps, such as Kraft, sulfite and sulfate pulps, as well as mechanical pulps including, groundwood, thermomechanical pulp, chemically modified, and the like. Chemical pulps may be used in tissue towel embodiments since they are known to those of skill in the art to impart a superior tactical sense of softness to tissue sheets made therefrom. Pulps derived from deciduous trees (hardwood) and/or coniferous trees (softwood) can be utilized herein. Such hardwood and softwood fibers can be blended or deposited in layers to provide a stratified web. Exemplary layering embodiments and processes of layering are disclosed in U.S. Pat. Nos. 3,994,771 and 4,300,981. Additionally, fibers derived from wood pulp such as cotton linters, bagesse, and the like, can be used. Additionally, fibers derived from recycled paper, which may contain any of all of the categories as well as other non-fibrous materials such as fillers and adhesives used to manufacture the original paper product may be used in the present web. In addition, fibers and/or filaments made from polymers, specifically hydroxyl polymers, may be used in the present invention. Non-limiting examples of suitable hydroxyl polymers include polyvinyl alcohol, starch, starch derivatives, chitosan, chitosan derivatives, cellulose derivatives, gums, arabinans, galactans, and combinations thereof. Additionally, other synthetic fibers such as rayon, polyethylene, and polypropylene fibers can be used within the scope of the present invention. Further, such fibers may be latex bonded. Other materials are also intended to be within the scope of the present invention as long as they do not interfere or counteract any advantage presented by the instant invention.

The fibrous structure may comprise any tissue-towel paper product known in the industry. Embodiment of these substrates may be made according U.S. Pat. No. 4,191,609 issued Mar. 4, 1980 to Trokhan; U.S. Pat. No. 4,300,981 issued to Carstens on Nov. 17, 1981; U.S. Pat. No. 4,191,609 issued to Trokhan on Mar. 4, 1980; U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,245,025 issued to Trokhan et al. on Sep. 14, 1993; U.S. Pat. No. 5,275,700 issued to Trokhan on Jan. 4, 1994; U.S. Pat. No. 5,328,565 issued to Rasch et al. on Jul. 12, 1994; U.S. Pat. No. 5,334,289 issued to Trokhan et al. on Aug. 2, 1994; U.S. Pat. No. 5,364,504 issued to Smurkowski et al. on Nov. 15, 1995; U.S. Pat. No. 5,527,428 issued to Trokhan et al. on Jun. 18, 1996; U.S. Pat. No. 5,556,509 issued to Trokhan et al. on Sep. 17, 1996; U.S. Pat. No. 5,628,876 issued to Ayers et al. on May 13, 1997; U.S. Pat. No. 5,629,052 issued to Trokhan et al. on May 13, 1997; U.S. Pat. No. 5,637,194 issued to Ampulski et al. on Jun. 10, 1997; U.S. Pat. No. 5,411,636 issued to Hermans et al. on May 2, 1995; EP 677612 published in the name of Wendt et al. on Oct. 18, 1995, and U.S. Patent Application 2004/0192136A1 published in the name of Gusky et al. on Sep. 30, 2004.

The tissue-towel substrates may be manufactured via a wet-laid making process where the resulting web is through-air-dried or conventionally dried. Optionally, the substrate may be foreshortened by creping or by wet microcontraction. Creping and/or wet microcontraction are disclosed in commonly assigned U.S. Pat. No. 6,048,938 issued to Neal et al. on Apr. 11, 2000; U.S. Pat. No. 5,942,085 issued to Neal et al. on Aug. 24, 1999; U.S. Pat. No. 5,865,950 issued to Vinson et al. on Feb. 2, 1999; U.S. Pat. No. 4,440,597 issued to Wells et al. on Apr. 3, 1984; U.S. Pat. No. 4,191,756 issued to Sawdai on May 4, 1980; and U.S. Pat. No. 6,187,138 issued to Neal et al. on Feb. 13, 2001.

Conventionally pressed tissue paper and methods for making such paper are known in the art. See commonly assigned U.S. Pat. No. 6,547,928 issued to Barnholtz et al. on Apr. 15, 2003. One suitable tissue paper is pattern densified tissue paper which is characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. Processes for making pattern densified tissue webs are disclosed in U.S. Pat. No. 3,301,746, issued to Sanford, et al. on Jan. 31, 1967; U.S. Pat. No. 3,974,025, issued to Ayers on Aug. 10, 1976; U.S. Pat. No. 4,191,609, issued to on Mar. 4, 1980; and U.S. Pat. No. 4,637,859, issued to on Jan. 20, 1987; U.S. Pat. No. 3,301,746, issued to Sanford, et al. on Jan. 31, 1967; U.S. Pat. No. 3,821,068, issued to Salvucci, Jr. et al. on May 21, 1974; U.S. Pat. No. 3,974,025, issued to Ayers on Aug. 10, 1976; U.S. Pat. No. 3,573,164, issued to Friedberg, et al. on Mar. 30, 1971; U.S. Pat. No. 3,473,576, issued to Amneus on Oct. 21, 1969; U.S. Pat. No. 4,239,065, issued to Trokhan on Dec. 16, 1980; and U.S. Pat. No. 4,528,239, issued to Trokhan on Jul. 9, 1985.

Uncompacted, non pattern-densified tissue paper structures are also contemplated within the scope of the present invention and are described in U.S. Pat. No. 3,812,000 issued to Joseph L. Salvucci, Jr. et al. on May 21, 1974; and U.S. Pat. No. 4,208,459, issued to Henry E. Becker, et al. on Jun. 17, 1980. Uncreped tissue paper as defined in the art are also contemplated. The techniques to produce uncreped tissue in this manner are taught in the prior art; for example, Wendt, et al. in European Patent Application 0 677 612A2, published Oct. 18, 1995; Hyland, et al. in European Patent Application 0 617 164 A1, published Sep. 28, 1994; and Farrington, et al. in U.S. Pat. No. 5,656,132 issued Aug. 12, 1997.

In one embodiment the plies of the multi-ply fibrous structure may be the same substrate respectively or the plies may comprise different substrates combined to create desired consumer benefits. In one embodiment the fibrous structures comprise two plies of tissue substrate. In another embodiment the fibrous structure comprises a first ply, a second ply, and at least one inner ply.

In one embodiment of the present invention, an embossment pattern is applied only to the first ply (e.g. the ply that faces outward toward the user when the product is in roll form), and therefore, each of the two plies serve different objectives and are visually distinguishable. For instance, the embossment pattern on the first ply provides, among other things, improved aesthetics regarding thickness and quilted appearance, while the second ply, being unembossed, is devised to enhance functional properties such as absorbency, thickness and strength. The two plies are joined in a face-to-face relationship, and when the sheet is laid out on a flat surface, the distortion and height of the cells of the first ply are enhanced via the first ply's adhesion, in one embodiment at the bond sites 20, to the second ply. In addition since the caliper of the product is optimized, one embodiment results in a rolled product having an enhanced roll firmness and the appearance of a more uniformly rolled product, wherein the product has a Percent Compressibility from about 1.5% to about 4.5%, in another embodiment from about 2% to about 4%, in another embodiment from about 2.5% to about 4%, as determined by the Percent Compressibility Method disclosed herein.

In another embodiment of the present invention, the embossed multi-ply fibrous structure product comprises an embossment height from about 350 μm to about 1,500 μm; in another embodiment from about 500 μm to about 1200 μm and in another embodiment from about 600 μm to about 1000 μm as measured by the Embossment Structure Measurement Method described herein.

In another embodiment, the multi-ply fibrous structure product has a plurality of cells, each cell having a surface area of from about 0.5 square inches to about 6 square inches or from about 1 to about 4 square inches, in another embodiment from about 1.5 square inches to about 3 square inches.

In another embodiment of the present invention, the embossed multi-ply fibrous structure product comprises densified and non-densified regions formed during papermaking.

In still yet another embodiment, the embossed multi-ply fibrous structure product is a two ply product that exhibits a sheet caliper of about 20 mils to about 40 mils, and/or from about 25 mils to about 35 as measured by the Sheet Caliper Test Method disclosed herein.

In one embodiment, the embossed multi-ply fibrous structure product has a basis weight of between about 22 $g/m^2$ and about 30 $g/m^2$. In another embodiment the basis weight is about 25 $g/m^2$ to about 30 $g/m^2$; and in yet another embodiment the basis weight is about 26 $g/m^2$ and about 29 $g/m^2$, as measured by the Basis Weight Method described herein.

A nonlimiting example of an embossed multi-ply fibrous structure product and latticework in accordance with the present invention is shown in FIG. 1. As shown in FIG. 1, a fragmentary plan view of a multiple ply paper product displaying an embodiment of a non random, repeating, essentially continuous, geometric embossment pattern latticework 28 on the first ply or the second ply according to the present invention. The embossments 22 form a latticework 28 defining a plurality of unembossed cells 25; wherein each cell has a surface area of from about 0.5 square inches to about 6 square inches, the cells being unadhered to the adjacent ply. In one embodiment adjacent embossments are discrete.

In one embodiment the latticework comprises a plurality of parallel emboss rows, wherein the distance between the parallel rows of emboss (μm), measured as the tangent line distance between parallel rows of emboss, is from about 0.05 inches to about 0.5 inches, in another embodiment from about 0.1 inches to about 0.3 inches, especially when the emboss height is from about 600 μm to about 1500 μm.

Figure 2:
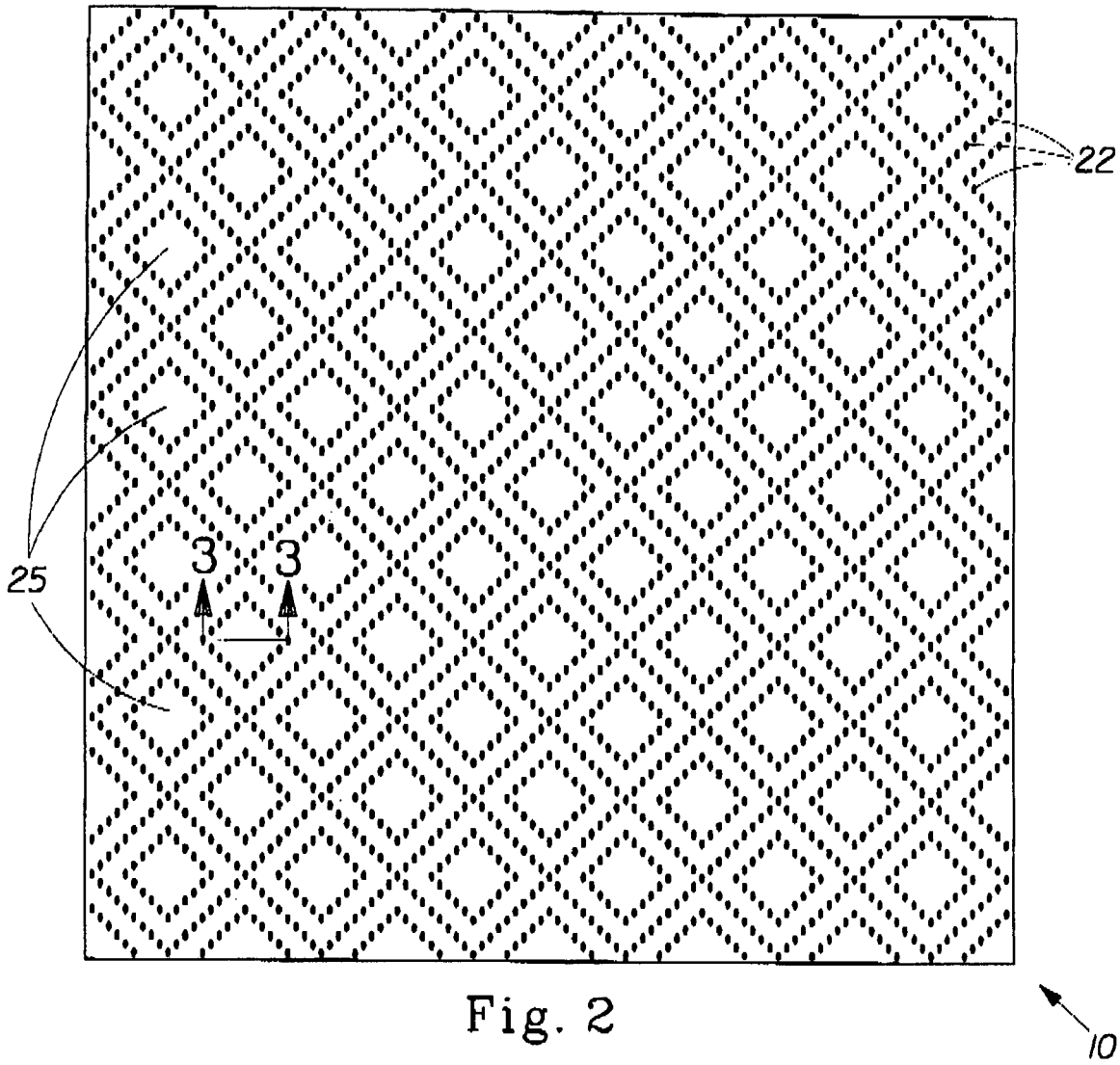
FIG. 2 is a perspective view of a paper towel sheet product having a non-random geometric repeating, essentially continuous, pattern latticework with a plurality of discrete embossments and unadhered cells.

Another nonlimiting example of an embossed multi-ply fibrous structure product in accordance with the present invention is shown in FIG. 2. The embossed multi-ply fibrous structure product 10 comprises two plies of fibrous structure wherein at least one of the piles has a plurality of embossments 22 thereon having a total embossment area of from about 6% to about 16%. The embossments 22 form a latticework defining a plurality of unembossed cells 25; wherein each cell has a surface area of from about 0.5 square inches to about 6 square inches, the cells being unadhered to the adjacent ply and the cells, bordered by embossments 22, comprising a cross section 3-3.

Figure 3:
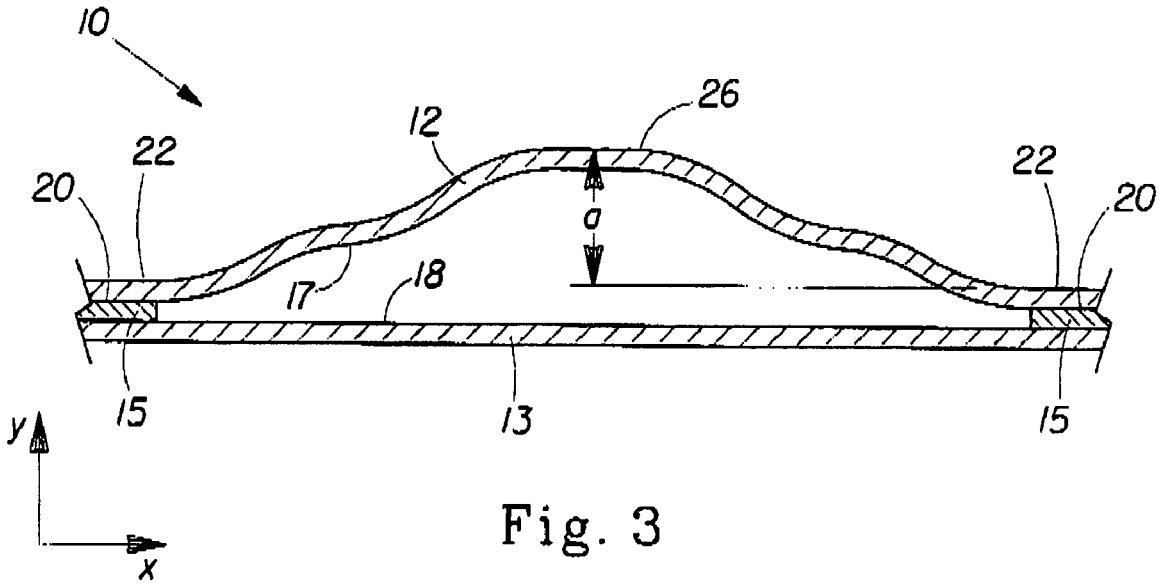
FIG. 3 is a cross section view of cell 3-3, bordered by embossments, of FIG. 2 showing a two ply fibrous structure having embossments.

Another nonlimiting example of an embossed two-ply fibrous structure product in accordance with cross section 3-3 of FIG. 2 is shown in FIG. 3. As shown in FIG. 3, the embossed two-ply fibrous structure product 10 comprises a first ply of fibrous structure 12 that comprises embossments and a second ply of fibrous structure 13 that is unembossed. The first ply 12 and the second ply 13 are adhesively bonded together by an adhesive 15 along their adjacent surfaces 17 and 18, respectively at bond sites 20. The embossed multi-ply fibrous structure product 10 further comprises embossments 22. The cell 25 exhibits an embossment height a of from about 600 μm to about 1000 μm. The embossment height extends in the y-direction from the x-plane of the embossed multi-ply fibrous structure product 10. The bond sites 20 are adhesively bonded together by adhesive 15.

Because of the deformation caused by the embossments 22 of first ply 12, the extensibility of second ply 13 as compared to first ply 12 constrains first ply 12 from being elongated substantially in the x plane of the paper product. Thus, in one embodiment the cells 25, since they are unadhered to the second ply 13, are free to pucker up and outward in the y direction, away from the second ply 13, especially when the product is unrolled and laid flat on a flat surface. The pucker is called the tufted ridge 26. In one embodiment the tufted ridge 26 created by the pucker is elongated in the MD direction.

In one embodiment, at least about 60% to about 95%, in another embodiment from about 70% to about 90% of the cells of the product have tufted ridges.

In one embodiment, for a rolled product, the difference in the average embossment height a of the first sheet taken off the roll (Sheet 1) and the fifth sheet taken off roll (Sheet 5), measured after the sheet is laid flat, is no more that from about 5% to about 20%, in another embodiment from about 10% to about 20%.

Suitable means of embossing include those disclosed in U.S. Pat. Nos. 3,323,983 issued to Palmer on Sep. 8, 1964; 5,468,323 issued to McNeil on Nov. 21, 1995; 5,693,406 issued to Wegele et al. on Dec. 2, 1997; 5,972,466 issued to Trokhan on Oct. 26, 1999; 6,030,690 issued to McNeil et al. on Feb. 29, 2000; and 6,086,715 issued to McNeil on July 11.

Suitable means of laminating the plies include but are not limited to those methods disclosed in commonly assigned U.S. Pat. Nos. 6,113,723 issued to McNeil et al. on Sep. 5, 2000; 6,086,715 issued to McNeil on Jul. 11, 2000; 5,972,466 issued to Trokhan on Oct. 26, 1999; 5,858,554 issued to Neal et al. on Jan. 12, 1999; 5,693,406 issued to Wegele et al. on Dec. 2, 1997; 5,468,323 issued to McNeil on Nov. 21, 1995; 5,294,475 issued to McNeil on Mar. 15, 1994.

The fibrous structures and/or embossed multi-ply fibrous structure product herein may optionally comprise one or more ingredients, such as softening agents, absorbency agents such as surfactants, wet strength agents, lotions, antibacterial agents, coloring agents, perfumes, and mixtures thereof.

The embossed multi-ply fibrous structure product may optionally comprise coloring agents, such as print elements.

The embossed multi-ply fibrous structure product may be in roll form. When in roll form, the embossed multi-ply fibrous structure product may be wound about a core or may be wound without a core.

EXAMPLES

Example 1

One fibrous structure useful in achieving the embossed paper product of the present invention is the through-air-dried (TAD), differential density structure described in U.S. Pat. No. 4,528,239. Such a structure may be formed by the following process.

A Fourdrinier, through-air-dried papermaking machine is used. A slurry of papermaking fibers is pumped to the headbox at a consistency of about 0.15%. The slurry comprises of about 55% Northern Softwood Kraft fibers, about 30% unrefined Eucalyptus fibers and about 15% repulped product broke. The fiber slurry contains a cationic polyamine-epichlorohydrin wet burst strength resin at a concentration of about 10.0 kg per metric ton of dry fiber, and carboxymethyl cellulose at a concentration of about 3.5 kg per metric ton of dry fiber.

Dewatering occurs through the Fourdrinier wire and is assisted by vacuum boxes. The wire is of a configuration having 41.7 machine direction and 42.5 cross direction filaments per cm, such as that available from Asten Johnson known as a "786 wire".

The embryonic wet web is transferred from the Fourdrinier wire at a fiber consistency of about 22% at the point of transfer, to a TAD carrier fabric. The sheet side of the carrier fabric consists of a continuous, patterned network of photopolymer resin, the pattern containing about 90 deflection conduits per inch. The polymer resin is supported by and attached to a woven support member. The consistency of the web is about 55% to about 75% after the action of the TAD dryers operating about a 254° C., before transfer onto the Yankee dryer. An aqueous solution of creping adhesive is applied to the Yankee surface by spray applicators. The web is creped with a doctor blade. The Yankee dryer and the Yankee hood are operated at about 120° C. to about 170° C. The dry, creped web is then passed between two calendar rolls and rolled on a reel.

The paper described above is then subjected to a knob-to-rubber impression embossing process as follows. An emboss roll is engraved with a nonrandom pattern of protrusions. The emboss roll is mounted, along with a backside impression roll, in an apparatus with their respective axes being generally parallel to one another. The height of the embossing protrusions on the emboss roll is such that to provide the emboss heights as disclosed herein. The nonrandom pattern of emboss protrusions comprises adequate emboss contact area to achieve the total emboss areas as disclosed herein. The backside impression roll has a P&J hardness of about 100 to about 110, available from Stowe Woodward (Youngsville, N.C.). The impression roll is set to deliver a nip length of about 1 to about 2 inches (5 cm) by applying a pressure of approximately 50 to about 440 pounds per linear inch (pli) of roller.

The resulting paper has an embossment height of from about 600 to about 1000 μm, an embossment area of about 13 to about 16 square inches.

Test Methods

The following describe the test methods utilized herein to determine the values consistent with those presented herein.

Embossment Structure Measurement Method

The geometric characteristics of the embossment structure of the present invention are measured using an Optical 3D Measuring System MikroCAD compact for paper measurement instrument (the "GFM MikroCAD optical profiler instrument") and ODSCAD Version 4.14 software available from GFMesstechnik GmbH, Warthestraβe E21, D14513 Teltow, Berlin, Germany. The GFM MikroCAD optical profiler instrument includes a compact optical measuring sensor based on digital micro-mirror projection, consisting of the following components:

A) A DMD projector with 1024×768 direct digital controlled micro-mirrors.

B) CCD camera with high resolution (1280×1024 pixels).

C) Projection optics adapted to a measuring area of at least 160×120 mm.

D) Recording optics adapted to a measuring area of at least 160×120 mm;

E) Schott KL1500 LCD cold light source.

F) A table stand consisting of a motorized telescoping mounting pillar and a hard stone plate;

G) Measuring, control and evaluation computer.

H) Measuring, control and evaluation software ODSCAD 4.14.

I) Adjusting probes for lateral (XY) and vertical (Z) calibration.

The GFM MikroCAD optical profiler system measures the height of a sample using the digital micro-mirror pattern projection technique. The result of the analysis is a map of surface height (Z) versus XY displacement. The system should provide a field of view of 160×120 mm with an XY resolution of 21 μm. The height resolution is set to between 0.10 μm and 1.00 μm. The height range is 64,000 times the resolution. To measure a fibrous structure sample, the following steps are utilized:

1. Turn on the cold-light source. The settings on the cold-light source are set to provide a reading of at least 2,800 k on the display.
2. Turn on the computer, monitor, and printer, and open the software.
3. Verify calibration accuracy by following the manufacturers instructions.
4. Select "Start Measurement" icon from the ODSCAD task bar and then click the "Live Image" button.
5. Obtain a fibrous structure sample that is larger than the equipment field of view and conditioned at a temperature of 73° F.±2° F. (about 23° C.±1° C.) and a relative humidity of 50%±2% for 2 hours. Place the sample under the projection head. Position the projection head to be normal to the sample surface.
6. Adjust the distance between the sample and the projection head for best focus in the following manner. Turn on the "Show Cross" button. A blue cross should appear on the screen. Click the "Pattern" button repeatedly to project one of the several focusing patterns to aid in achieving the best focus. Select a pattern with a cross hair such as the one with the square. Adjust the focus control until the cross hair is aligned with the blue "cross" on the screen.
7. Adjust image brightness by increasing or decreasing the intensity of the cold light source or by altering the camera gains setting on the screen. When the illumination is optimum, the red circle at the bottom of the screen labeled "I.O." will turn green.
8. Select "Standard" measurement type.
9. Click on the "Measure" button. The sample should remain stationary during the data acquisition.
10. To move the data into the analysis portion of the software, click on the clipboard/man icon.
11. Click on the icon "Draw Cutting Lines." On the captured image, "draw" a cutting line that extends from the center of a negative embossment through the centers of at least six negative embossments, ending on the center of a final negative embossment. Click on the icon "Show Sectional Line Diagram." Move the cross-hairs to a representative low point on one of the left hand negative embossments and click the mouse. Then move the cross-hairs to a representative low point on one of the right hand negative embossments and click the mouse. Click on the "Align" button by marked point's icon. The Sectional Line Diagram is now adjusted to the zero reference line.
12. Measurement of Emboss Height, "a". Using the Sectional Line Diagram described in step 11, click the mouse on a representative low point of a negative emboss, followed by clicking the mouse on a representative point on the nearby upper surface of the sample. Click the "Vertical" distance icon. Record the distance measurement. Repeat the previous steps until the depth of six negative embossments have been measured. Take the average of all recorded numbers and report in mm, or μm, as desired. This number is the embossment height.
13. Measurement of Emboss Area, A. Using the Sectional Line Diagram of step 11, select with the mouse two points on each wall of a negative embossment that represents 50% of the depth measured in step 12. Click the "horizontal distance" icon. The horizontal distance is the diameter of an equivalent circle. The area of that circle is calculated using the formula Area=2*pi*(d/2)^2 and is recorded as the Equivalent Emboss Area. If the embossment shape is elliptical or irregular, more sectional lines are needed, cutting through the embossment from different directions, to calculate the equivalent area. Repeat these steps for the six negative embossments measured in step 12.

Total Embossment Area

If the fibrous structure product has an essentially continuous repeating pattern of embossments, first calculate the total number of emboss knobs in each unit of the repeating emboss pattern ("unit"). Then calculate the area of a knob. Embossments are usually based on plane geometry shapes such as circles or ovals, etc. For such plane geometry figures, the area is calculated via known math formulas, for example for the area of a circle of radius R, the area is $Pi*R^2$. The area of an ellipse of semi-major axis of length A and semi-minor axis of length B (semi-major axes are half the lengths of, respectively, the largest and smallest diameters of the ellipse), the area is $$\text{Area}=\text{Pi}*A*B,$$

Then multiply the total number of knobs times the emboss area/knob to determine the emboss area for that unit. Then calculate the area of the unit. To determine the Total Embossment Area for the ply, divide the total emboss area for the unit by the area for that unit.

Sheet Caliper Test Method

Sheet Caliper or Caliper of a sample of fibrous structure product is determined by cutting a sample of the fibrous structure product such that it is larger in size than a load foot loading surface where the load foot loading surface has a circular surface area of about 3.14 $in^2$. The sample is confined between a horizontal flat surface and the load foot loading surface. The load foot loading surface applies a confining pressure to the sample of 14.7 $g/cm^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in mils.

Percent Compressibility Test Method

Percent of Roll Compressibility (Percent Compressibility) is determined as follows. Measure Original Roll Diameter on a roll which has a smooth tail sheet laying flat across the roll. Place the roll on the Roll Diameter Tester so that the end of the roll is flush with the vertical side plate of the tester. The tail sheet perforated edge should come off the top of the roll and be facing the grader. Attach the diameter tape to the bar and then, loop the diameter tape around the circumference of the roll at the center of the roll and let the weighted end hang freely, having 100 gram weight. Wait 3 seconds and record the Original Roll Diameter measurement to the nearest 0.01 inch. With the diameter tape still in place, hang an additional 1000 gram weight for a total of 1,100 grams, to measure the Compressed Roll Diameter. Wait 3 seconds and record the reading on the tape to the nearest 0.01 inch. Calculate percent compressibility to the nearest 0.1% according to:

$$\%\ \text{Compressibility} = \frac{\text{Original Roll Diameter} - (\text{Compressed Roll Diameter})}{\text{Original Roll Diameter}} \times 100$$

To determine the Percent Compressibility take an average of 10 roll samples.

The Roll Diameter Tester is comprised of two perpendicularly attached flat metal plates each with a width of 6 inches to about 12 inches and length of about 1.5 ft. to about 3 ft. The bottom (horizontal) plate rests on a flat countertop and the other plate extends vertically therefrom. The top of vertical plate has a shaft where the core of the rolls slides in so that the core is orientated parallel to the bottom plate. Above the shaft is a bar that is parallel to the shaft and also extends above the shaft to support the diameter tape. The 100 gram weight, with two hooks (one on each end), is attached to the roll diameter tape that hangs below the roll, and the second hook is used to attach the 1000 gram weight used to determine the Compressed Roll Diameter.

The diameter tape may be any commercially available diameter tape where one side is graduated, for example, in 16ths of an inch and is a standard ruler. The other side is used to measure diameters and is graduated in 100ths of an inch. For example, tape may be graduated so that the circumference of the cylindrical object is divided by the mathematical constant pi, the resulting diameter is plotted on the rule such that Diameter=Circumference/pi.

All measurements referred to herein are made at 23+/−1° C. and 50% relative humidity, unless otherwise specified.

All publications, patent applications, and issued patents mentioned herein are hereby incorporated in their entirety by reference. Citation of any reference is not an admission regarding any determination as to its availability as prior art to the claimed invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An embossed multiply fibrous structure product in roll form comprising:

a first ply of fibrous structure comprising a plurality of embossments thereon having a total embossment area of from about 6% to about 16%;

a second ply of unembossed fibrous structure;

the embossments forming a latticework defining a plurality of unembossed cells; wherein each unembossed cell has a surface area of from about 0.5 square inch to about 6 square inches, the unembossed cells being unadhered to the adjacent second ply;

the embossments having a height from about 600 μm to about 1,500 μm;

the first ply faces outward toward the user;

the product is a paper towel product having a Percent Compressibility from about 1.5% to about 4.5%; a sheet caliper from about 20 mils to about 40 mils; the product consisting essentially of circle shaped embossments; and at least one of the first ply or the second ply is a through air dried fibrous structure.

2. The product of claim 1 wherein the Percent Compressibility is from about 2% to about 4%.

3. The product of claim 1 wherein the cell surface area is from about 0.5 square inch to about 4 square inches.

4. The product of claim 3 wherein the cell surface area is from about 0.5 square inch to about 3 square inches.

5. The product of claim 1 wherein the total embossment area is from about 13% to about 16%.

6. The product of claim 1 wherein the embossment height is from about 600 μm to about 1,200 μm.

7. The product of claim 1 wherein the product comprises only the first ply and the second ply.

8. The product of claim 7 further comprising bond sites wherein the embossments extend outwardly from the plane of the first ply towards and contacting the second ply, the plies being joined to one another at the bond sites.

9. The product of claim 8 wherein the first ply and the second ply are bonded together with an adhesive applied only in the bond sites.

10. The product of claim 1 wherein the sheet caliper is from about 25 mils to about 35 mils.

11. The product of claim 1 further comprising Emboss Spacing of from about 0.05 inch to about 0.5 inch.

12. The product of claim 1 wherein the first ply and the second ply comprise a through-air-dried fibrous structure ply.

13. An embossed multiply fibrous structure product in roll form comprising:

a first ply of fibrous structure comprising a plurality of embossments thereon having a total embossment area of from about 6% to about 16%;

a second ply of unembossed fibrous structure;

the embossments forming a latticework defining a plurality of unembossed cells; wherein each unembossed cell has a surface area of from about 0.5 square inch to about 6 square inches, the unembossed cells being unadhered to the adjacent second ply;

the embossments having a height from about 350 μm to about 1,500 μm;

the first ply faces outward toward the user;

the product has a Percent Compressibility from about 1.5% to about 4.5%; a sheet caliper from about 20 mils to about 40 mils; and the product consisting essentially of circle shaped embossments.

14. The product of claim 13 wherein the Percent Compressibility is from about 2% to about 4%.

15. The product of claim 13 wherein the cell surface area is from about 0.5 square inch to about 4 square inches.

16. The product of claim 15 wherein the cell surface area is from about 0.5 square inch to about 3 square inches.

17. The product of claim 13 wherein the total embossment area is from about 13% to about 16%.

18. The product of claim 13 wherein the embossment height is from about 600 μm to about 1,200 μm.

19. The product of claim 13 wherein the product comprises only the first ply and the second ply.

20. The product of claim 13 further comprising bond sites wherein the embossments extend outwardly from the plane of the first ply towards and contacting the second ply, the plies being joined to one another at the bond sites.

21. The product of claim 20 wherein the first ply and the second ply are bonded together with an adhesive applied only in the bond sites.

22. The product of claim 13 wherein the sheet caliper is from about 25 mils to about 35 mils.

23. The product of claim 13 further comprising Emboss Spacing of from about 0.05 inch to about 0.5 inch.

* * * * *